US005336084A

United States Patent [19]

Long

[11] Patent Number: 5,336,084

[45] Date of Patent: Aug. 9, 1994

[54] LIQUID FUEL CAMPSTOVE WITH ELECTRONIC IGNITION

[75] Inventor: Norris R. Long, Wichita, Kans.

[73] Assignee: The Coleman Company, Inc., Wichita, Kans.

[21] Appl. No.: 74,133

[22] Filed: Jun. 9, 1993

[51] Int. Cl.[5] ..... F23D 14/62

[52] U.S. Cl. ..... 431/354; 431/255; 431/278; 126/37 R; 126/39 E; 126/39 BA; 126/38

[58] Field of Search ..... 431/255, 344, 354, 355, 431/278, 281, 284; 126/39 R, 39 E, 41 R, 25 B, 24, 38, 52, 37 R

[56] References Cited

U.S. PATENT DOCUMENTS

| | | | |
|---|---|---|---|
| Re. 29,457 | 10/1977 | Hastings . | |
| 2,609,870 | 9/1952 | Riebman et al. | 431/355 X |
| 3,561,896 | 2/1971 | Riehl | 126/39 E X |
| 3,692,016 | 9/1972 | Stikkers et al. | 431/278 X |
| 3,714,938 | 2/1973 | Spotts | 126/38 |
| 3,783,856 | 1/1974 | Amos | 126/38 |
| 4,122,764 | 10/1978 | D'Ambra | 126/38 X |
| 4,288,978 | 9/1981 | Wyatt | 431/281 X |
| 4,691,136 | 9/1987 | Schmidt . | |
| 4,870,314 | 9/1989 | Hefling . | |

FOREIGN PATENT DOCUMENTS

| | | | |
|---|---|---|---|
| 289037 | 8/1913 | Fed. Rep. of Germany | 126/42 |
| 1021076 | 2/1953 | France | 431/281 |

OTHER PUBLICATIONS

Parts List for Coleman Electronic Ignition Propane Campstove Model 5435B700, published Mar., 1992.

MSR Stove System Instruction Manual (date of publication unknown, but prior to 1992).

*Primary Examiner*—Larry Jones

[57] ABSTRACT

A liquid fuel campstove is provided with a piezoelectric ignition system. The campstove includes a liquid fuel tank, a burner assembly having a fuel inlet and fuel outlet orifices, a generator tube which is connected to the fuel tank and extends adjacent the burner assembly, and a U-shaped venturi tube which extends from the generator to the fuel inlet of the burner assembly. A pilot tube is inserted into the venturi tube and extends to adjacent the fuel outlet orifices of the burner assembly. The electrode of the piezoelectric ignition system is positioned adjacent the end of the pilot tube.

16 Claims, 5 Drawing Sheets 6
6

LIQUID FUEL CAMPSTOVE WITH ELECTRONIC IGNITION

BACKGROUND

This invention relates to liquid fuel campstoves, and, more particularly, to liquid fuel campstoves with a piezoelectric electronic ignition system.

Conventional liquid fuled stoves are match lit. This requires the customer to strike a match and hold it near the stove's main burner and then to properly set the stove fuel control valve for the ignition cycle. This is inconvenient, and the difficulty of getting everything done quickly and in the right order, particularly in wet and windy conditions, can result in an excessive amount of unvaporized fuel collecting in the lower part of the stove's burner venturi area. The excess fuel condition is called flooding and results in a lazy yellow-colored flame which extends a few inches above the burner. This flame gradually subsides as the excess fuel is depleted and the generator gets hot.

In a conventional liquid fueled stove such as the ones which Coleman has offered for many years, fuel is contained in a pressure vessel into which air is pumped under pressure. See, for example, U.S. Pat. No. Re. 29,457. The vessel is equipped with a dip tube which extends to nearly the bottom of the tank. The dip tube is closed at the bottom with the exception of a small diameter orifice through which fuel is allowed to enter. The dip tube has an internal conduit which is open at the bottom and which communicates with the upper part of the pressure vessel above the maximum intended fuel level. The dip tube orifice can be partly blocked by insertion of a needle which is suitably connected to the fuel control system so as to cause it to partly block the orifice during the lighting cycle and to leave the orifice unblocked during the normal burn cycle. The upper end of the dip tube is connected through a valve system to a generator. The generator is a metal tube which passes above the burner of the stove into a venturi assembly which is connected to a burner. Fuel is discharged at high velocity from an orifice at the end of the generator into the venturi where air is aspirated and mixed and fed to the burner as a combustible mixture for burning. During the lighting cycle, unvaporized gasoline is discharged through the orifice and is not readily ignitable. To overcome this problem, the dip tube needle is used to partly block the fuel entry orifice. This creates a pressure imbalance within the dip tube which permits pressurized air to flow through the passageway inside of the dip tube from above the fuel. This pressurized air mixes with the liquid fuel and moves with it to be discharged from the generator orifice. The air fuel mixture at discharge consists of fuel-vapor-laden air and atomized droplets of fuel which can be readily ignited.

In the conventional arrangement, the pressure vessel is an elongated cylinder which is hung in a horizontal orientation on the outside of a case which contains the venturi and burner assemblies. The venturi is U-shaped, and the generator discharge orifice is inserted in one of the legs of the "U". The burner is attached at a 90° angle to the end of the other leg of the "U". In this configuration, the mixture of fuel vapor-laden air and atomized droplets of fuel must make a 180° turn and a 90° turn before finally reaching the burner for combustion. Under start up, the venturi parts are cold and contact between the mixture and the cold metal causes much of the liquid fuel to drop out. This in turn causes the fuel air mixture at the burner to be at the low end of the range of combustibility (lean) and difficult to light. This condition becomes more severe at lower ambient temperatures.

Campstoves and lanterns have been provided which include a piezoelectric ignition device. For example, U.S. Pat. Nos. 4,691,136 and 4,870,314 describe lanterns with a piezoelectric ignitor. Coleman has also offered propane fueled campstoves with piezoelectric ignition.

In a liquid fuel campstove the air fuel mixture at the burner becomes too lean to be ignited by a piezoelectric ignitor once ambient temperature falls to about 40° F. Match lighting of the appliance also becomes increasingly difficult, and the appliance is prone to flooding prone below this temperature.

SUMMARY OF THE INVENTION

The improvement in start cycle performance is achieved by connecting a pilot fuel/air tube constructed of metal tubing with an internal diameter of about ¼ inch between the upper part of the venturi and the burner. The inlet of the pilot tube is generally aligned with the axis of the fuel/air stream which is discharged from the generator. The outlet of the tube is V-shaped like a fish mouth and is positioned adjacent the discharge electrode of the piezoelectric ignition system.

The pilot tube bends are smooth and the inlet of the tube is positioned within the venturi at a point where the fuel/air velocity is near its maximum. These factors cause a significantly richer mixture to be pressent at the piezo spark gap than would otherwise be discharged from the main burner. The V-shaped mouth of the tube is used to cause the piezo spark to jump from the discharge electrode to the at the location where the most ideal fuel/air mix exists. The pilot tube is equipped with a rolled screen which serves as a flash back arrestor and also serves to limit the velocity of fuel/air stream which is discharged from the pilot tube to avoid having the flame blow itself out after being ignited. It also avoids a blow torch effect once ignition does occur.

DESCRIPTION OF THE DRAWING

The invention will be explained in conjunction with the illustrative embodiment shown in the accompanying drawing, in which.

DESCRIPTION OF SPECIFIC EMBODIMENT

Figure 1:
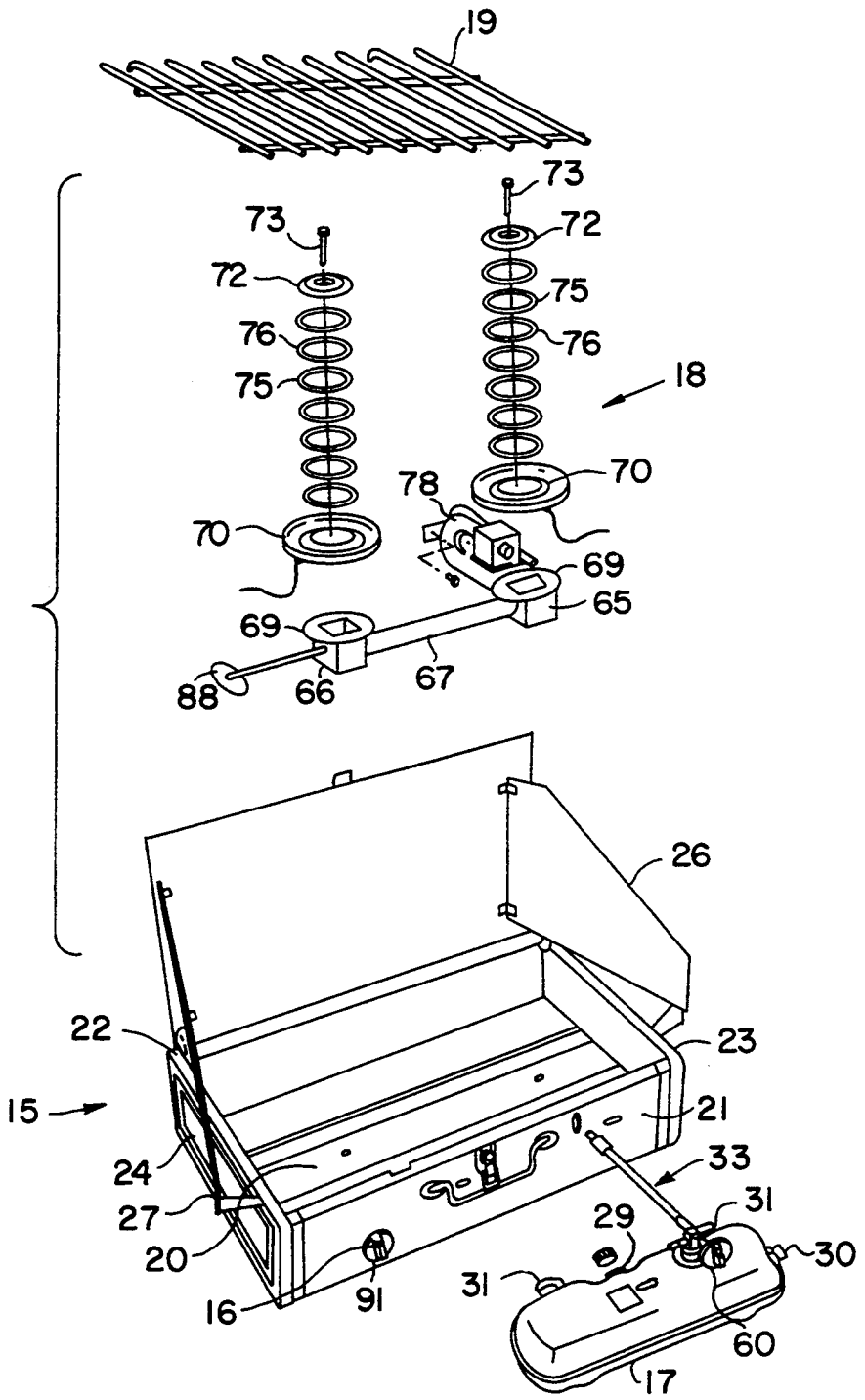
FIG. 1 is an exploded perspective view of a campstove formed in accordance with the invention.

Referring to FIG. 1, a campstove 15 includes a case 16, a fuel tank 17, a burner assembly 18, and a grate 19. The case 16 includes a bottom wall 20, front and back walls 21 and 22, a pair of side walls 23 and 24, and a lid 25 which is hingedly secured to the back wall 22. A pair of windscreens 26 and 27 are hingedly secured to the bottom surface of the lid.

The fuel tank 18 is a conventional Coleman liquid fuel tank which includes a fill spout 29 and an air pump assembly 30. The fuel tank is removably mounted on the front wall of the case by a pair of mounting hooks 31 which can be inserted through slots in the front wall.

Figures 4, 5, 6:
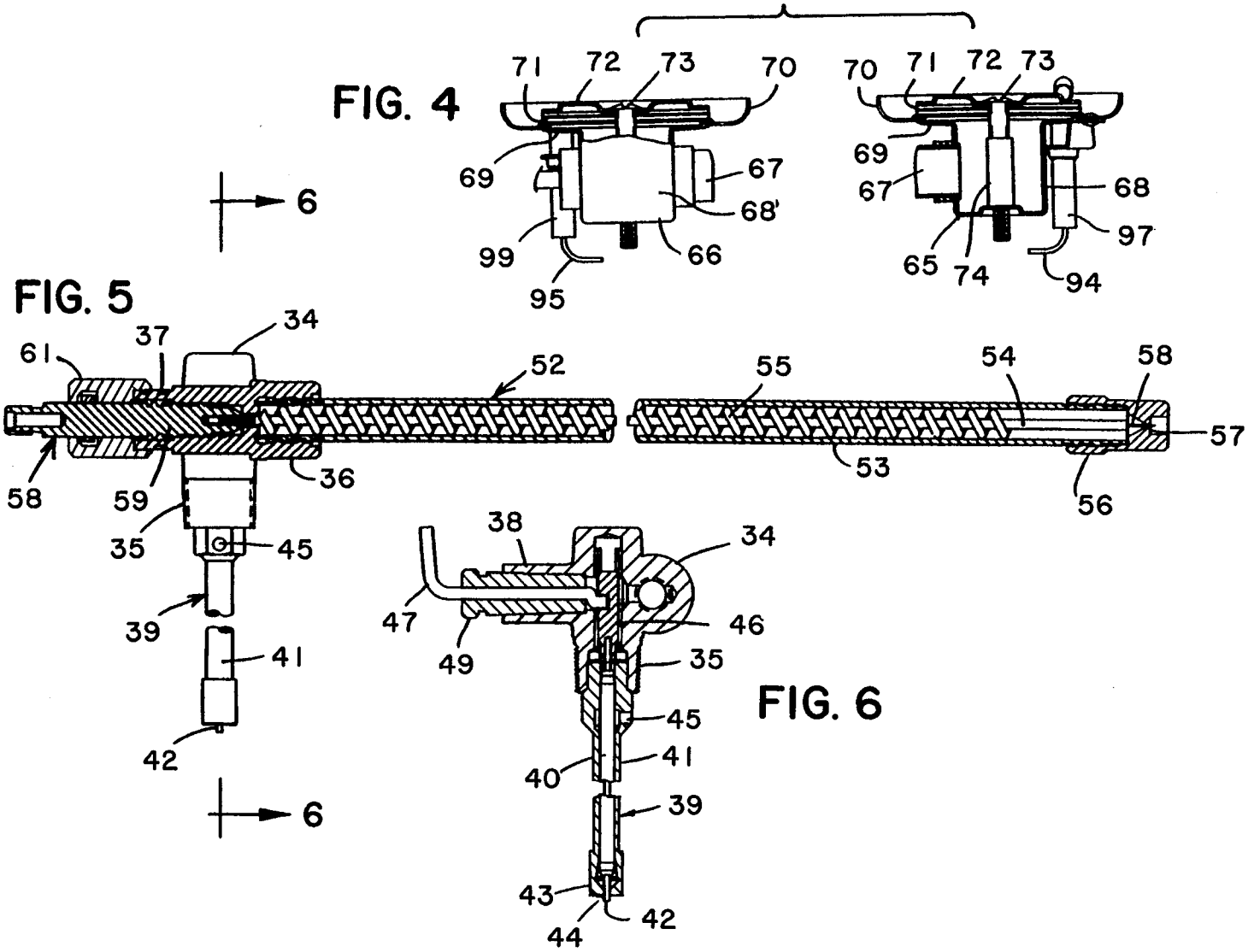
FIG. 4 is a fragmentary sectional view of the burner assembly.
FIG. 5 is a fragmentary sectional view of the fuel pickup and generator assembly.
FIG. 6 is a fragmentary sectional view taken along the line 6—6 of FIG. 5.

A conventional generator and fuel pick-up assembly 33 is threadedly secured in the top of the fuel tank. Referring to FIGS. 5 and 6, the assembly 33 includes a housing 34 which includes a downwardly extending bushing 35, a rearwardly extending bushing 36, a forwardly extending bushing 37, and a laterally extending bushing 38. A fuel pick-up tube assembly 39 is screwed into the downwardly extending bushing 35 and includes inner and outer concentric tubes 40 and 41 and a restrictor rod 42. A cap 43 on the bottom of the outer tube 41 is provided with a fuel inlet 44, and the upper end of the outer tube is provided with an air inlet 45. The restrictor rod 42 is attached to a block 46 which is reciprocably mounted in the housing 34. The restrictor rod can be moved into and out of the fuel inlet 44 by a crank 47 which extends through the lateral bushing 38. The crank is rotatably supported by a nut 49 which is screwed into the lateral bushing. The operation of the fuel pick-up tube assembly is well known and is explained, for example, in U.S. Pat. No. Re. 29,457.

A generator assembly 52 is screwed into the rearwardly extending bushing 37 and includes a generator tube 53, a central rod 54, and a helical spring 55. A cap 56 is threadedly secured to the end of the generator tube 53 and is provided with a fuel orifice or jet 57. A needle 58 on the end of the rod 54 can be moved into and out of the fuel jet 57 by the rod 54.

The forward end of the rod 54 is secured to a gas control valve assembly 58. The control valve assembly includes a shaft 59 which is threaded into the forwardly extending bushing 37 and a control knob 60 (FIGS. 1 and 2) which is mounted on the end of the shaft 59. The shaft extends through a nut 61 which is secured over the outside of the bushing 37. When the control knob 60 is rotated counterclockwise, the shaft 59 and the rod 54 move to the left in FIG. 5, and the needle 58 is withdrawn from the gas jet 57 to permit fuel to flow through the gas jet. The rate of flow of fuel through the gas jet can be controlled by adjusting the position of the needle within the gas jet by the control knob 60. When the needle is inserted fully into the gas jet, flow of fuel is shut off.

Referring to FIGS. 1, 3, 4, 7, and 8, the burner assembly 18 includes a main burner 65 and an auxiliary burner 66 which are connected by a crossover tube 67. Each of the burners is a conventional Coleman burner and includes a burner box 68 having a top flange 69, a burner bowl 70 which is supported by the top flange, a plurality of burner rings 71, and a cap 72. A bolt 73 is screwed into a bushing 74 on the burner box and clamps the parts of the burner together. The particular burner rings illustrated have been sold for many years under the trademark Band-A-Blu and are described, for example, in U.S. Pat. No. 3,933,146. The burner rings include alternating flat rings 75 (FIG. 1) and corrugated rings 76 which provide a plurality of fuel outlet orifices.

A generally U-shaped venturi or bunsen tube 78 (FIG. 7) includes a first or upper open end 79 and a second or bottom end 80 which extends into an inlet opening in the burner box 68 of the main burner 65. The top and bottom end portions of the venturi tube extend generally parallel and generally horizontal and are connected by a U-shaped central portion 81 which curves through an arc of about 180°. The upper end portion includes a reduced-diameter venturi portion 82. The particular venturi tube illustrated is formed from a pair of clamshell halves 83 and 84 (FIG. 8), each of which includes a central flange 85 and 86. The flange 85 is crimped over the flange 86, and the two clamshell halves are secured by brazing. With the exception of the pilot tube which will be described hereinafter, the venturi tube is also conventional. The venturi tube is attached to the case 16 by a support bracket 87.

When the fuel tank 17 is mounted on the case 16, the generator tube 53 extends through an opening in the front wall of the case and into the open end 79 of the venturi tube 78. The inside diameter of the open end 79 is larger than the outside diameter of the generator tube, and combustion air is aspirated into the venturi tube as fuel flows through the fuel jet of the generator tube.

CONVENTIONAL OPERATION

The conventional operation of Coleman liquid fuel campstoves which were heretofore available has already been described. The liquid fuel in the fuel tank 17 is pressurized by the air pump 30. During start-up, the crank 47 is rotated so that the restrictor rod 42 is positioned within the fuel inlet 44 of the fuel pick-up tube assembly. A match is lit and held near the burner rings of the main burner 65, and the valve control knob 60 is rotated counterclockwise. A fuel and air mixture flows through the fuel jet 57 and aspirates additional air through the open end of the venturi tube. The fuel/air mixture flows around the 180° bend in the venturi tube, into the burner box 68, and upwardly and through the orifices provided by the burner rings 75 and 76 where the fuel/air mixture is ignited by the match. After the flame of the main burner heats the generator tube 53 sufficiently to vaporize the fuel flowing through the generator tube, the crank 47 is rotated to move the restrictor rod out of the fuel inlet 44, and only liquid fuel without air flows upwardly through the inner tube of the fuel pick-up tube assembly.

After start-up, a valve which blocks flow through the crossover tube 67 between the two burners may be opened to allow vaporized fuel to flow into the auxiliary burner 66. The valve is operated by a handle 88 which is positioned outside of the side wall 24 of the case. A match is lit and held near the burner rings of the auxiliary burner before the valve is opened.

ELECTRONIC IGNITION

Figure 2:
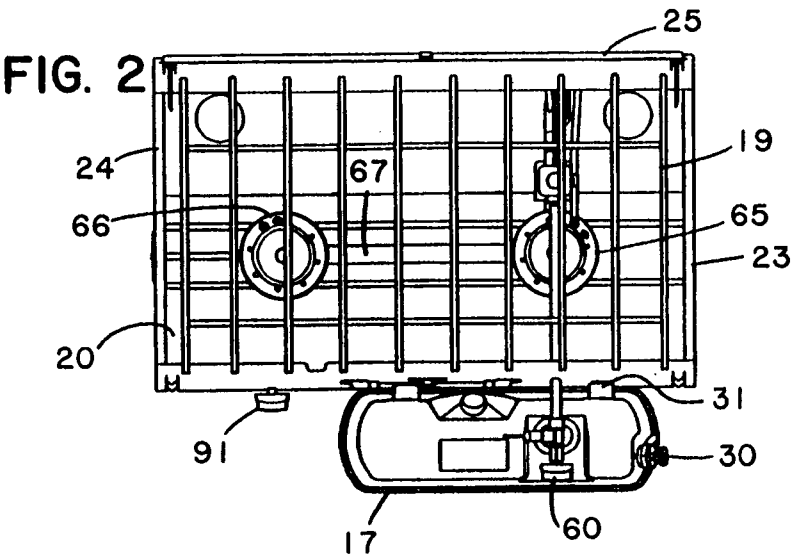
FIG. 2 is a top plan view of the campstove.
Figure 12:
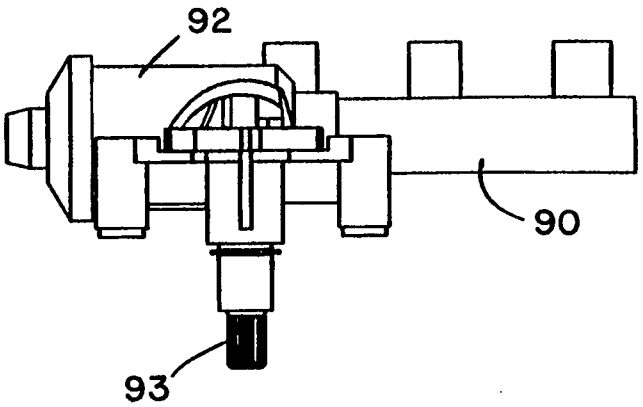
FIG. 12 is a plan view of the piezoelectric ignitor.

A conventional piezoelectric ignitor assembly 90 (FIG. 12) is mounted on the front wall of the case 16 and is operated by a knob 91 (FIGS. 1 and 2). Piezoelectric ignition devices are well known and are described, for example, with lanterns in U.S. Pat. Nos. 4,691,136 and 4,870,314. Piezoelectric ignitors have also been used with propane campstoves.

The piezoelectric ignitor assembly includes a housing 92, a pair of piezoelectric crystals within the housing, and a spring-actuated impact hammer which can be operated to strike the crystals. The hammer is operated by a shaft 93 which extends through the front wall of the case and which is rotated by the knob 91. The particular ignitor assembly is a Mark 24-36 ignitor from Channel Products, Inc., 7100 Wilson Mills Rd., Chesterland, Ohio 44026.

Figure 3:
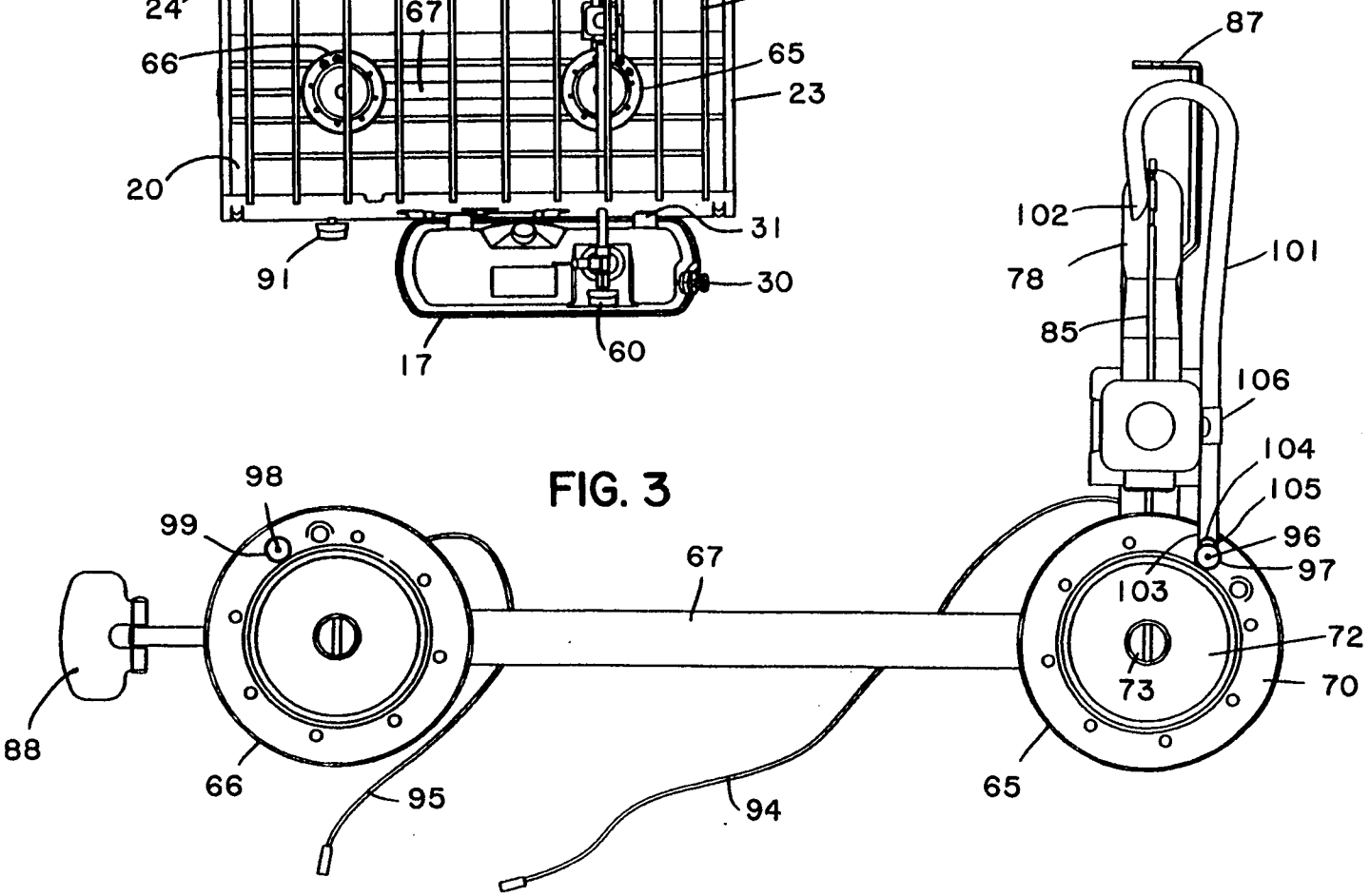
FIG. 3 is a top plan view of the venturi and burner assembly.

When the hammer strikes the piezoelectric crystals, a voltage is created which is conducted away from the crystals by a pair of wires 94 and 95 (FIG. 3). The wire 94 is connected to an electrode 96 which is supported by a cylindrical insulator 97 (see also FIG. 4). The insulator and electrode extend through the burner bowl 70 of the main burner 65, and the end of the electrode extends above the top of the insulator adjacent the burner rings.

The wire 95 is similarly connected to an electrode 98 for the auxiliary burner 66. The electrode 98 is supported by a cylindrical insulator 99, and the exposed upper end of the electrode is positioned adjacent the burner rings of the auxiliary burner.

Figure 7:
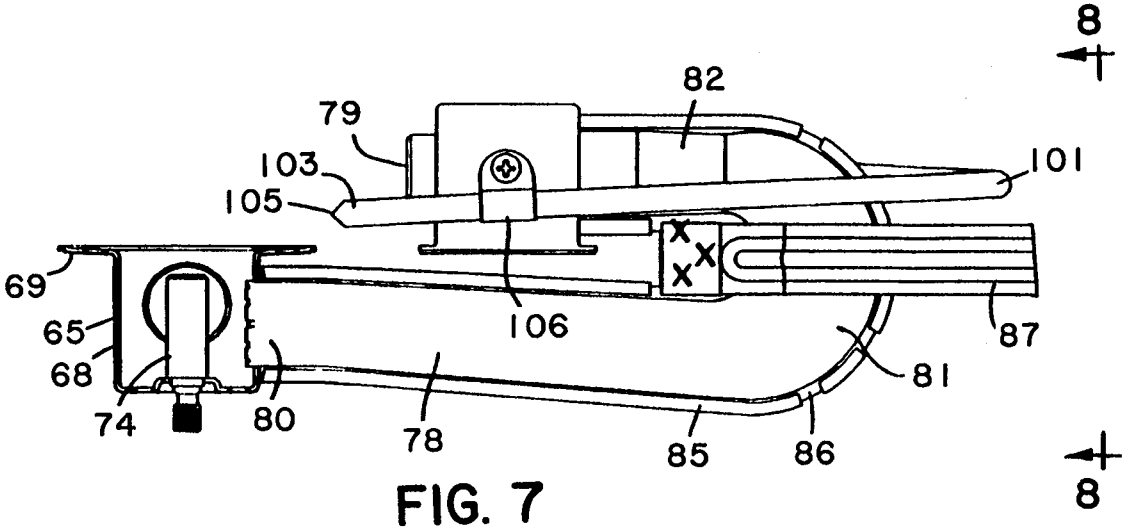
FIG. 7 is a side elevational view, partially in section, of the venturi and burner assembly.
Figure 9:
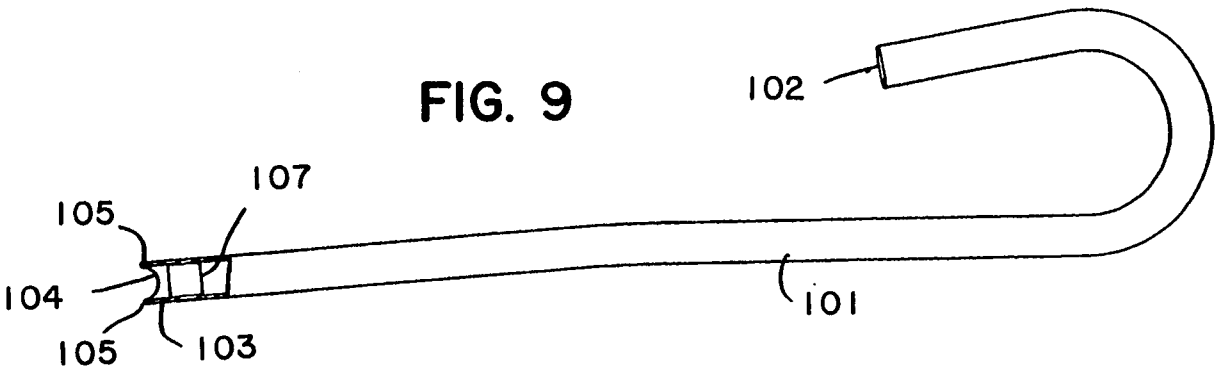
FIG. 9 is a top plan view, partially broken away, of the pilot tube.

A pilot tube 101 includes a first end 102 which extends through an opening in the upper straight leg of the venturi tube 78 and which is secured thereto and a second end 103 which terminates adjacent the electrode 96 and the burner rings of the main burner 65. The end 103 has a fish-mouth shape which is provided by a pair of diametrically opposed notches 104 (FIG. 9) which provide a pair of pointed tabs 105 (FIGS. 3, 7, and 9). The tabs 105 are positioned approximately equidistant from the electrode 96 and provide spark gaps between the electrode and the pilot tube. When the piezoelectric ignitor is operated by the knob 91, a spark arcs from the electrode to one of the tabs 105.

The first end 102 of the pilot tube extends about $\frac{1}{8}$ inch into the venturi, and the axis of the pilot tube at the first end is generally aligned with the axis of the generator tube 53. The axis of the generator tube is generally coaxial with the axis of the upper leg of the U-shaped venturi tube. Because of the clamshell construction of the venturi tube, the first end of the pilot tube is offset slightly to one side of the vertical midplane of the venturi tube and the axis of the generator tube (see FIGS. 3 and 8). The pilot tube extends rearwardly from the venturi tube, curves smoothly through about a 180° bend, and extends forwardly toward the main burner.

Figure 8:
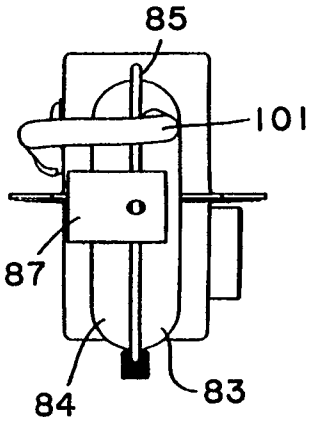
FIG. 8 is a rear elevational view taken along the line 8—8 of FIG. 7.

As can be seen in FIGS. 7 and 8, when the case 16 is supported in the intended horizontal position, the pilot tube is downwardly inclined from the point where it exits the venturi tube to the second end 103. The incline allows any liquid fuel which collect inside of the pilot tube to drain from the second end onto the burner bowl 70. Drainage is facilitated by the fishmouth-shaped end of the tube. The forward end of the pilot tube is supported by a bracket 106 which is secured to the venturi.

Figure 10:
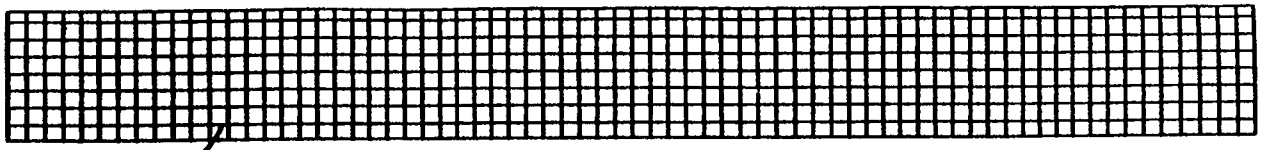
FIG. 10 is a plan view of the arrestor screen before the screen is rolled and staked.
Figure 11:
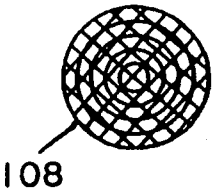
FIG. 11 is an end view of the rolled screen.

A mesh screen 107 (FIG. 9) is positioned inside of the pilot just inwardly of the second end 103. Referring to FIG. 10, the screen is initially formed as a flat strip about 3/16 inch wide and about $1\frac{3}{4}$ inch long. The mesh size is 40×40 openings per inch. The screen is rolled into a cylindrical porous plug 108 having a length of 3/16 inch (FIG. 11), and the rolled screen is secured by staking. The rolled screen is pressed into the second end of the pilot tube.

OPERATION OF THE ELECTRONIC IGNITION

The fuel tank 17 is pressurized as previously described, and the crank 47 positions the restrictor rod 42 in the fuel inlet of the fuel pick-up assembly. When the fuel control knob 60 is opened, a fuel/air mixture flows through the fuel jet of the generator tube as previously described. The first end 102 of the pilot tube is generally aligned with the fuel jet of the generator tube and is positioned at a point where the fuel/air velocity is near its maximum. This causes a significantly richer fuel/air mixture to flow into the pilot tube than would otherwise reach the burner rings by flowing through the venturi tube. Most of the fuel/air mixture flows through the venturi tube. However, a portion of the fuel/air mixture flows through the pilot tube to the second end 103 of the pilot tube where it is ignited by the spark which arcs between the electrode 96 and one of the pointed tabs 105 of the pilot tube when the piezo ignitor knob 91 is rotated. The resulting flame at the end of the pilot tube ignites the main flow of fuel/air mixture which flows through the venturi tube, into the burner box 68, and through the burner rings of the main burner.

The rolled screen 107 serves as a flashback arrestor which prevents flame from traveling back through the pilot tube, limits the velocity of the fuel/air stream which is discharged from the pilot tube, limits the temperature of the flame of the pilot tube, controls the length of the flame, and directs the hot portion of the flame to an area adjacent the burner rings. The flame of the pilot tube burns at about 300 to 1200 Btu's while the flame of the burner rings burns at about 2000 or 3000 up to about 15,000 Btu's, depending upon the adjustment of the fuel control valve.

After the generator is heated and fuel which flows through the generator tube is vaporized, the crank 47 is rotated to move the restrictor rod 42 out of the fuel inlet of the fuel pick-up assembly. Vaporized fuel then flows through the fuel jet 57 of the generator tube 53 and aspirates air through the open end of the venturi tube. Although some of the fuel/air mixture flows into the pilot tube, most of the fuel/air mixture flows through the venturi tube, into the burner box, and through the burner rings, where it burns to provide a flame around the burner rings. The fuel/air which flows through the pilot tube provides only a small flame at the open end of the pilot tube.

After start-up, the valve for the auxiliary burner 66 can be opened, and the fuel/air mixture which flows through the burner rings of the auxiliary burner can be ignited by operating the control knob 91 of the piezoelectric ignitor to cause a spark to arc from the electrode 98 to the burner rings of the auxiliary burner.

The preferred embodiment of the pilot tube 101 has an outside diameter of about $\frac{1}{4}$ inch and a wall thickness of about 0.025 inch and is preferably formed from mild steel. The pilot tube is secured to the venturi tube by brazing during the same brazing operation which secures the two clamshell halves of the venturi tube. Pilot tubes formed from different materials and having different diameters could also be used. However, the mild steel tube facilitates brazing without melting, and a steel tube of less than about $\frac{1}{4}$ inch might sag during exposure to brazing temperatures which can reach 2000° F.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. A campstove comprising:

a fuel tank for holding fuel, a burner assembly for burning the fuel and providing a flame, the burner assembly including a fuel inlet and fuel outlet orifices, fuel conduit means for conveying fuel from the fuel tank to the burner, the fuel conduit means including a first fuel conduit for conveying fuel from the fuel tank, means for aspirating air into the fuel conveyed by the first fuel conduit, and a second fuel conduit for conveying a fuel and air mixture from the first fuel conduit to the fuel inlet of the burner, a pilot tube extending from said second fuel conduit to adjacent the fuel outlet orifices of the burner assembly for conveying a fuel and air mixture, the pilot tube having a first end which is inserted into the second fuel conduit and a second end which is adjacent the fuel outlet orifices, and fuel ignition means for igniting fuel which flows from the second end of the pilot tube.

2. The campstove of claim 1 in which the fuel ignition means comprises an electrode adjacent the second end of the pilot tube and a piezoelectric ignition device connected to the elctrode.

3. The campstove of claim 2 in which the second end of the pilot tube is provided with a pair of generally diametrically opposed notches and a pair of tabs which are separated by the notches, said electrode being positioned adjacent one of said tabs so that a spark can jump between the electrode and said one tab when the piezoelectric ignition device is operated.

4. The campstove of claim 1 including a screen positioned within the pilot tube adjacent the second end thereof.

5. The campstove of claim 4 in which said screen has a mesh size of about 40×40.

6. The campstove of claim 4 in which said screen is helically wound.

7. The campstove of claim 1 including a case which supports the burner assembly, the case having a bottom wall which is adapted to be supported generally horizontally, said pilot tube being inclined downwardly from the first end thereof to the second end when the bottom wall is horizontal whereby liquid fuel within the pilot tube can drain out of the second end of the pilot tube.

8. The campstove of claim 7 in which the burner assembly includes a burner bowl below the fuel outlet orifices, the second end of the pilot tube terminating above the burner bowl.

9. The campstove of claim 8 in which said fuel ignition means including an electrode which extends upwardly through the burner bowl and terminates adjacent the second end of the pilot tube.

10. The campstove of claim 1 in which the pilot tube has an outside diameter of about ¼ inch.

11. The campstove of claim 10 in which the pilot tube is mild steel.

12. The campstove of claim 1 in which said first fuel conduit has a fuel outlet orifice and said first end of the pilot tube is generally aligned with the fuel outlet orifice of the first fuel conduit.

13. The campstove of claim 1 in which said second fuel conduit comprises a generally U-shaped tube having a first open end and a second end which is connected to the fuel inlet of the burner, said first fuel conduit being inserted into the open end of the U-shaped tube and having a fuel orifice which is generally aligned with the axis of the U-shaped tube, the first end of the pilot tube being generally aligned with the fuel orifice of the first fuel conduit.

14. The campstove of claim 1 in which the burner assembly includes a burner bowl below the fuel outlet orifices, the second end of the pilot tube terminating above the burner bowl.

15. The campstove of claim 14 in which said fuel ignition means including an electrode which extends upwardly through the burner bowl and terminates adjacent the second end of the pilot tube.

16. The campstove of claim 1 in which the first fuel conduit includes a generator portion which extends adjacent the burner for vaporizing liquid fuel within the generator portion when the generator portion is heated by the flame of the burner.

* * * * *